US010989155B2

(12) United States Patent
Lopez

(10) Patent No.: US 10,989,155 B2
(45) Date of Patent: Apr. 27, 2021

(54) METHOD OF RETARDING INJECTION TIMING OF A FUEL INJECTOR

(71) Applicant: Progress Rail Services Corporation, Albertville, AL (US)

(72) Inventor: Rolando Lopez, Lehigh Acres, FL (US)

(73) Assignee: Progress Rail Services Corporation, Albertville, AL (US)

( * ) Notice: Subject to any disclaimer, the term of this patent is extended or adjusted under 35 U.S.C. 154(b) by 180 days.

(21) Appl. No.: 15/491,196

(22) Filed: Apr. 19, 2017

(65) Prior Publication Data

US 2018/0306154 A1 Oct. 25, 2018

(51) Int. Cl.
*F02M 57/02* (2006.01)
*F02M 45/06* (2006.01)

(52) U.S. Cl.
CPC ..... *F02M 57/023* (2013.01); *F02M 45/066* (2013.01)

(58) Field of Classification Search
CPC ... F02M 61/161; F02M 57/023; F02M 45/066
USPC ..... 123/445
See application file for complete search history.

(56) References Cited

U.S. PATENT DOCUMENTS

| | | | | |
|---|---|---|---|---|
| 5,271,366 | A | 12/1993 | Shimada et al. | |
| 6,321,723 | B1 | 11/2001 | Buescher | |
| 6,763,810 | B1 | 7/2004 | Buescher | |
| 6,799,561 | B2 | 10/2004 | Stewart et al. | |
| 6,945,233 | B2 | 9/2005 | Stewart et al. | |
| 7,191,766 | B1 | 3/2007 | Gregory Lee et al. | |
| 2007/0012297 | A1* | 1/2007 | Stewart | F02M 57/023 123/501 |
| 2007/0227508 | A1* | 10/2007 | Lee | F02M 57/023 123/500 |

FOREIGN PATENT DOCUMENTS

JP H10318090 A 12/1998

* cited by examiner

*Primary Examiner* — Lindsay M Low
*Assistant Examiner* — Omar Morales
(74) *Attorney, Agent, or Firm* — Brannon Sowers & Cracraft

(57) ABSTRACT

A method comprises determining either the coefficient for the equation relating the injection timing distance of a bushing to the angle of rotation of a shaft of an engine, or the desired effective injection stroke reduction; and calculating at least one of the following: the modified injection timing distance by multiplying the desired angle of retardation of the injection timing by the coefficient and adding that product to the original injection timing distance of the bushing, and the modified injection duration distance by subtracting the desired effective injection stroke reduction from the original injection duration distance.

11 Claims, 4 Drawing Sheets

METHOD OF RETARDING INJECTION TIMING OF A FUEL INJECTOR

TECHNICAL FIELD

The present disclosure relates generally to fuel injectors that use various methods and devices to alter the timing of the injection for the fuel injector. More specifically, the present disclosure relates to a method of retarding the injection timing of a fuel injector such as a mechanical unit injector by altering the barrel or bushing design of the injector.

BACKGROUND

Electro-Motive Diesel, Inc. (hereinafter EMD) type unit injectors are injectors that feature mechanical unit injectors (as opposed to electronic control) and are widely used in the diesel engine industry, including the locomotive industry. However, with the increase of concern of harmful emissions from diesel engines and overall energy conservation, modifications to EMD-type unit injectors have become necessary so as to be more environmental friendly.

Although the prevalence of photochemical smog in metropolitan areas spurred the first public interest in reducing noxious emissions from exhaust emissions, reducing output of all types of harmful emissions, including carbon monoxide (CO), hydrocarbons (HC) and nitrous oxides (NOx) has become one of the goals of the diesel engine industry. Through the years, the diesel engine industry has greatly reduced the smoke, carbon monoxide and hydrocarbons emitted into the atmosphere. However, it is the nitrous oxides and particulate emissions that remain one of the plaguing problems for diesel engines.

In addition, there is a demand for improved fuel economy in order to reduce the costs of operating equipment and to also further reduce the emissions produced while running the equipment.

One method known in the art to reduce emissions is to retard or otherwise adjust the injection timing of a fuel injector so that the combustion in a diesel engine or the like is altered, producing less emissions.

More specifically, in order to reduce the amount of nitrogen oxides emitted, the injector should create less heat in the combustion chamber. One method to create less heat, and thereby produce less nitrogen oxides, is by retarding the injection timing of the fuel injectors. By retarding the timing of diesel fuel injections, the combustion process occurs at a later time in the power stroke. By retarding the timing, the combustion temperature and pressure are lowered, thereby causing less nitrogen oxides to form. The amount of nitrogen oxide lessens with higher levels of retard.

A previous method for adjusting injection timing on EMD engines is to set the injector's port-closing position with reference to the engine cam position. With roots-blown engines this is done when the cylinder piston is two degrees before top dead center. For turbo-charged engines this is done when the cylinder piston is in its top dead center position. In both instances, the associated engine cam follower is still in following contact with the base circle of the associated engine cam, that is, there is maximum spring-driven retraction of the drive linkage that powers the injector pump plunger, but this retraction may vary somewhat from a desired norm due to variations in conditions encountered when installing or reinstalling the injector, or due to wear of elements of the drive linkage during use, thereby causing improper timing.

The drive linkage (which includes the associated engine cam, a rocker arm assembly, a socket pad on the head of the adjusting screw and a spring-loaded tappet or follower carried by the injector pad and slidably engaged by the pad) powers the injector pump to actuate the injector plunger as determined by the engine cam profile. One possible method for retarding timing is by adjusting the screw on the output end of the engine rocker arm. As the adjusting screw is turned, the free length of the adjusting screw below the output end of the rocker arm is changed and creates a new set screw set point. As a result, the drive linkage is either shortened or lengthened until there is a predetermined specified timing distance between the top face of the follower and a fixed surface, namely the top flat face of the injector body. The specified timing distance is the distance that is obtained when the port closure of the helix of the plunger is above the point at which it will close off its associated spill port in the plunger bushing to thereby initiate injection, which is known as its set point. The set point is usually listed on the engine manufacturer's data plate. If the set point listed on the data plate does not match with the set point for the now retarded injector, a new setting gauge and new engine marking must be provided.

In addition, the new timing distance specification or adjusting screw set point prescribed to retard injection timing may vary from engine model to engine model. This variation creates a potential for human error wherein a mechanic must use multiple gages to set multiple engines.

Consequently, various other ways of adjusting the injection timing of the injector have been developed. For example, U.S. Pat. No. 6,321,723 to Buescher discloses a plunger that has modified helices to retard the injection timing of the fuel injector. That is to say, the upper helix is machined so that its distance to the upper port of the bushing of the injector is increased, resulting in a delay of injection. However, this design has the drawback that it can be difficult and/or costly to machine complex geometry such as helical geometry on the plunger.

U.S. Pat. No. 7,191,766 to Lee et al. discloses modifying the effective length of the actual follower component in order to retard the injection timing. Typically, the effective length of the follower is decreased, requiring more time and distance for the plunger to initiate the injection phase. However, this also has the tendency to increase the injection volume of the injector, which may be undesirable for reasons set forth above.

Accordingly, it is desirable to develop an apparatus and/or method to alter the injection timing of a fuel injector that is less costly and that may actually reduce the amount of fuel injected.

SUMMARY OF THE DISCLOSURE

A bushing for use with a fuel injector according to an embodiment of the present disclosure is provided. The bushing may comprise a substantially cylindrical body defining a cylindrical axis, an upper end, and a lower end disposed along the cylindrical axis, and the body includes a main body portion disposed proximate the lower end and a necked down portion disposed proximate the upper end with a shoulder connecting the necked down portion to the main body portion. The body also defines a central bore extending completely through the body from the upper end to the lower end along the cylindrical axis. The main body portion includes an outer circumferential surface and defines a top port extending from the outer circumferential surface to the central bore, the top port forming an bottom inside portion at the intersection of the top port with the central bore, and the main body portion defines a bottom port extending from the outer circumferential surface to the central bore, the bottom port forming a top inside portion at the intersection of the bottom port with the central bore. The main body portion defines an injection timing distance measured along the cylindrical axis from the shoulder to bottom inside portion of the top port, and the main body portion defines a main body height measured along the cylindrical axis from the shoulder to the lower end, and a ratio of the main body height to the injection timing distance ranges from 1.9 to 2.2. In such embodiments, the injection duration distance ranges from 4.0 to 4.4. Similarly, in some of these embodiments, the injection timing distance ranges from 1.98 to 2.035 or 2.04 to 2.16. In some of these embodiments, the injection duration distance ranges from 4.36 to 4.39 or 4.0 to 4.2. In some these embodiments, the bushing defines an overall injection adjustment ratio that equals the ratio of the injection timing distance to the injection duration distance, and this ratio ranges from 1.9 to 2.250. In some embodiments, the overall injection adjustment ratio ranges from 1.90 to 2.006 or 2.15 to 2.205.

A fuel injector assembly according to an embodiment of the present disclosure is provided comprising a housing that defines a pressurized fuel chamber, a check valve assembly in fluid communication with the pressurized fuel chamber, a plunger disposed in the housing, and a bushing disposed in the housing configured to guide the movement of the plunger. The bushing includes a substantially cylindrical body defining a cylindrical axis, an upper end, and a lower end disposed along the cylindrical axis, and the body includes a main body portion disposed proximate the lower end and a necked down portion disposed proximate the upper end with a shoulder connecting the necked down portion to the main body portion. The body also defines a central bore extending completely through the body from the upper end to the lower end along the cylindrical axis and the main body portion includes an outer circumferential surface. Also, the main body portion defines a top port extending from the outer circumferential surface to the central bore, the top port forming an bottom inside portion at the intersection of the top port with the central bore; and the main body portion defining a bottom port extending from the outer circumferential surface to the central bore, the bottom port forming a top inside portion at the intersection of the bottom port with the central bore. The main body portion defines a main body height measured along the cylindrical axis from the shoulder to the lower end and defines an injection duration distance measured along the cylindrical axis from the bottom inside portion of the top port to the top inside portion of the bottom port and a ratio of the main body height to the injection duration distance ranges from 4.0 to 4.4. In some of these embodiments, the injection timing distance may range from 1.9 to 2.2. In some embodiments, the ratio of the main body height to the injection duration distance ranges from 4.36 to 4.39 or 4.0 to 4.2. In particular embodiments, the ratio of the main body height to the injection timing distance ranges from 1.98 to 2.035 or 2.04 to 2.16. In such embodiments, the bushing defines an overall injection adjustment ratio that equals the ratio of the injection timing distance to the injection duration distance, and this ratio ranges from 1.9 to 2.250. In some embodiments, the overall injection adjustment ratio ranges from 1.90 to 2.006 or 2.15 to 2.205.

A method is provided in certain embodiments of the present disclosure and comprises determining either the coefficient for the equation relating the injection timing distance of a bushing to the angle of rotation of a shaft of an engine, or the desired effective injection stroke reduction defined by the bushing; and calculating at least one of the following: the modified injection timing distance by multiplying the desired angle of retardation of the injection timing by the coefficient and adding that product to the original injection timing distance of the bushing, and the modified injection duration distance by subtracting the desired effective injection stroke reduction from the original injection duration distance.

DETAILED DESCRIPTION

Figure 1:
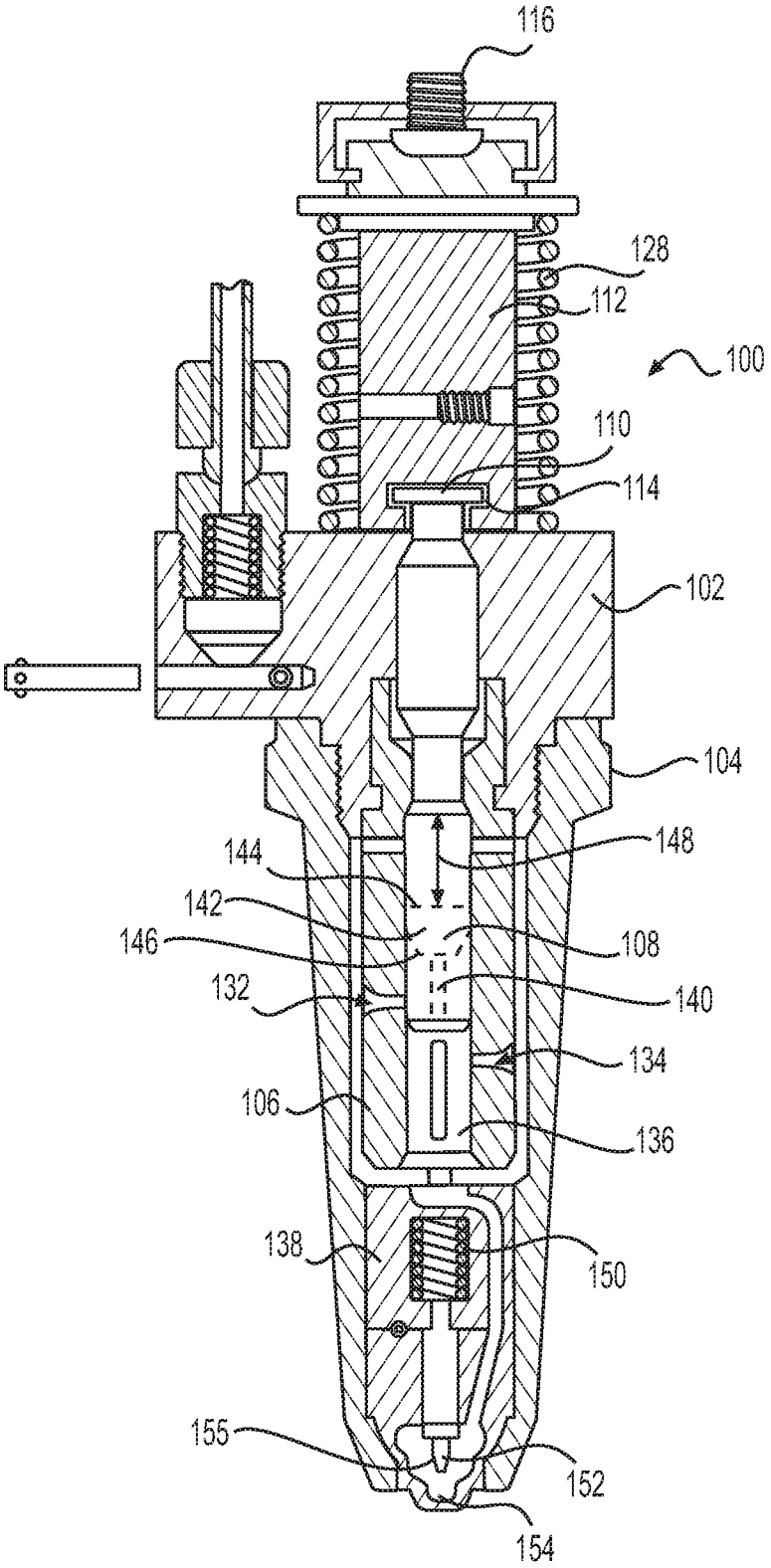
FIG. 1 is a cut-away side view of a fuel injector assembly that may use a bushing according to various embodiments of the present disclosure, illustrating the general operation of the fuel injector.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A method for modifying or manufacturing a bushing, the resulting bushing, and the fuel injector assembly that may use such a bushing according to various embodiments of the present disclosure will now be described. While the application discussed herein is primarily a mechanical unit injector, so-called as the injection is powered mechanically, it is to be understood that in other embodiments the fuel injector that uses the method or bushing described herein may be powered to inject in another manner, such as hydraulically, etc. Similarly, the type of fuel injected by the injector may be varied and includes diesel fuel, gasoline, etc. Accordingly, the applications of the embodiments discussed herein are applicable to a host of engine types and to a host of machines driven by such engines.

Figure 2:
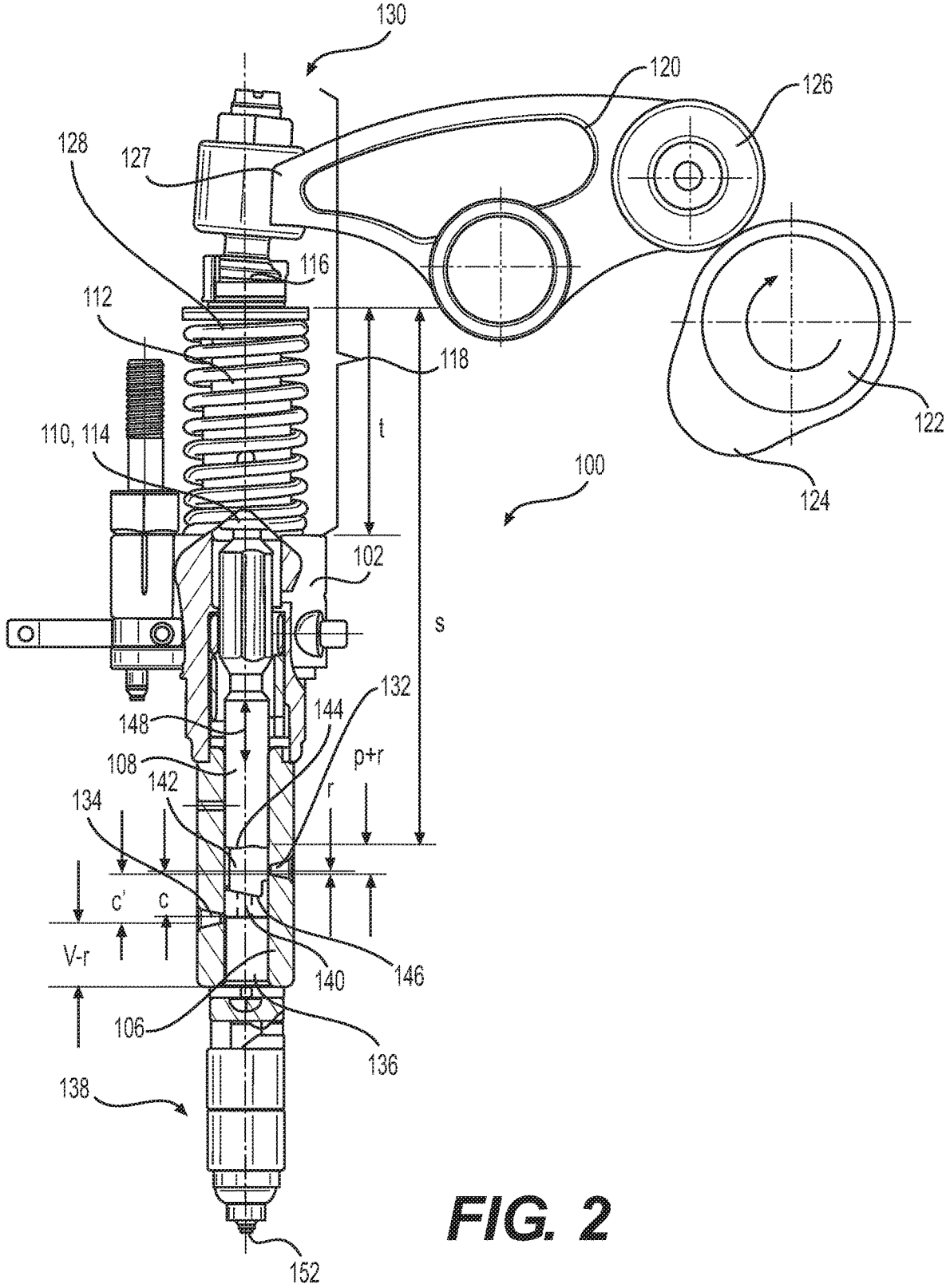
FIG. 2 is a partial cut-away side view of the fuel injector assembly of FIG. 1 with the housing removed, showing the internal details of the plunger and bushing of the fuel injector assembly more clearly.

Referring now to FIGS. 1 and 2, the general principles of operation of a mechanical unit injector that may use various embodiments of the bushing and/or method of the present disclosure will first be described. The fuel injector assembly 100 includes a body 102 of a conventional unit injector. A valve nut or housing 104 holds the pump barrel or bushing 106 to the body 102. A pump plunger 108 having a plunger head 110 is slidably received within the pump bushing 106. A pump follower 112 of the present disclosure includes a t-slot 114 receives the plunger head 110 of the pump plunger 108. Thus, the pump plunger 108 and pump follower 112 are in end-to-end arrangement and move as one unit when in use. An adjusting screw 116 is located on a flat top surface of the pump follower 112 and is part of a linkage assembly 118 connecting the follower 112 to the rocker arm 120. This screw 116 may be used to control the effective length of the follower 112, changing the injection timing as mentioned previously herein.

As a consequence of all this structure, rotation of the cam shaft 122 will cause the lobe 124 of the cam shaft 122 to contact the rocker arm 120, causing the right end 126 of the rocker arm 120 to lift upwardly while the left end 127 of the rocker arm 120 dips downwardly, imparting a downward motion to the follower 112 and the plunger 108, eventually initiating an injection event. As the cam shaft 122 continues to rotate, the lobe 124 will pass the right end 126 of the rocker arm 120, allowing the return spring 128 to force the left end 127 of the rocker arm 120 upwardly. This in turns lifts the follower 112 and the plunger 108, readying the fuel injector for another injection event.

As can be seen, the cam shaft 122, rocker arm 120, follower 112 and plunger 108 may be described together as the injection powering device 130. In other words, this is the device 130 that provides the force to power the injection of the fuel. It is to be understood that any suitable injection powering device may be used including a hydraulically powered device, a common rail pressurized fuel source, etc. So, in some embodiments, the fuel pressurization chamber may be more generally characterized as a pressurized fuel chamber because the fuel may be pressurized elsewhere.

Furthermore, the a mechanical injection powering device such as that depicted in FIGS. 1 and 2 may also be varied. For example, the cam shaft may be an overhead cam shaft that is in direct contact with the follower, eliminating the need for a rocker arm. Also, the connection between the follower and the plunger may be accomplished in another manner other than using a T-slot such as by fastening the components together or making them integral with each other, etc.

During a downward stroke of the plunger 108, initiated by the injection powering device 130, there is initially no injection of fuel. This is true since the pressurization chamber 136, located below the bottom of the plunger 108 and above the check valve assembly 138 is in fluid communication with the fuel source (not shown), supplying fuel to the fuel injector assembly 100 through the bushing 106. Specifically, the bushing 106 includes a top port 132 and a bottom port 134 for the admittance and remittance of fuel. As best seen in FIG. 2, the plunger 108 defines a central orifice 140 disposed on the bottom surface of the plunger 108 that is in fluid communication with the circumferential groove 142 bound on its upper end by a upper helix 144 and on its lower end by a lower helix 146. In the configuration shown in FIG. 2, the circumferential groove 142 is in communication with the top port 132 as the top port 132 is located between both the upper and lower helices 144, 146 along the direction of travel 148 of the plunger 108. At the same time, the bottom surface of the plunger 108 is above the bottom port 134.

Consequently, the fuel in the pressurization chamber 136 is not pressurized yet by the movement of the plunger 108 as this fuel may egress from the pressurization chamber 136 through either the bottom port 134 or through the central orifice 140, to the circumferential groove 142, and out the top port 132. Since no fuel has been pressurized in the pressurization chamber 136, the check valve spring 150 of the check valve assembly 138 is able to provide enough downward force on the valve pin 152 to keep the valve pin 152 seated against the valve seat 154. Hence, no fuel can enter into the combustion chamber (not shown).

As the plunger 108 continues to move downward, the bottom port 134 is eventually covered up by the plunger 108, such that fuel may no longer egress through the bottom port 134. At about the same time, the upper helix 144 approaches the top port 132. This motion continues until the upper helix 144 passes the bottom portion of the top port 132, such that fuel may no longer egress through the top port 132 as well.

This signals the beginning of the injection phase as fuel in the pressurization chamber 136 may no longer exit out the top and bottom ports 132, 134, creating a buildup of pressure in the pressurization chamber 136 that eventually produces enough force on the angled surface 155 proximate the free end of the valve pin 152 (see FIG. 1) to lift the valve pin 152 upwards against the force exerted on the valve pin 152 by the check valve return spring 150.

The injection phase continues as the plunger 108 moves downwardly and the lower helix 146 passes the upper portion of the bottom port 134. At this time, the fuel in the pressurization chamber 136 may flow through the central orifice 140 to the circumferential groove 142 and out the bottom port 134. This results in a drop in pressure until insufficient force is exerted by the fuel on the angled surface 155 of the valve pin 152 to counteract the spring force exerted by the check valve return spring 150. So, the valve pin 152 moves downward until the valve pin is seated once more on the valve seat 154, shutting off the injector from the combustion chamber, ending the injection phase (see FIG. 2).

Next, the lobe 124 of the cam shaft 122 passes the right end 126 of the rocker arm 120, allowing the return spring 128 to lift the follower 112 and the plunger 108 as previously described. This upward motion continues until the top port 132 and bottom port 134 are in fluid communication with the fuel pressurization chamber 136, allowing the chamber to be recharged, readying the injector to start the process all over again.

Figure 3:
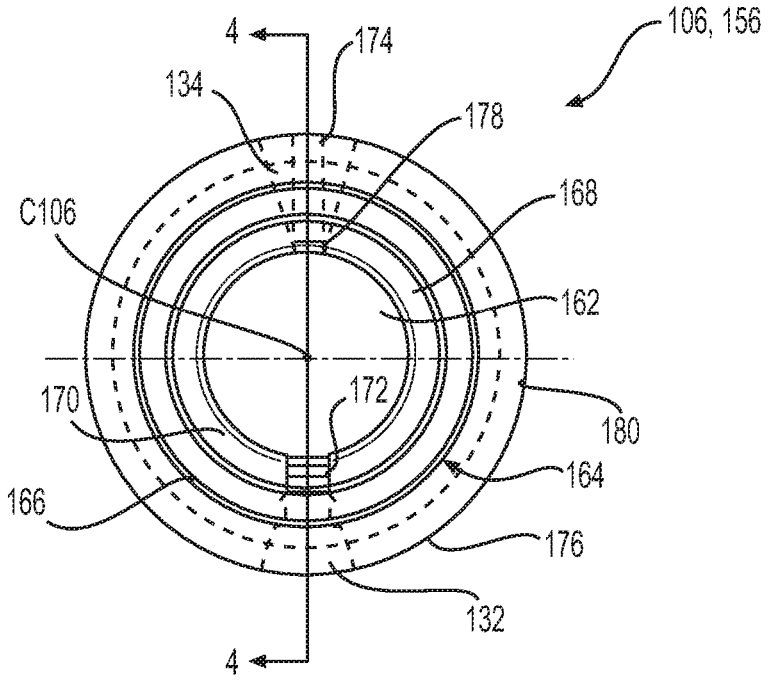
FIG. 3 is a top view of the bushing of the fuel injector assembly of FIG. 2 removed from the fuel injector assembly.
Figure 4:
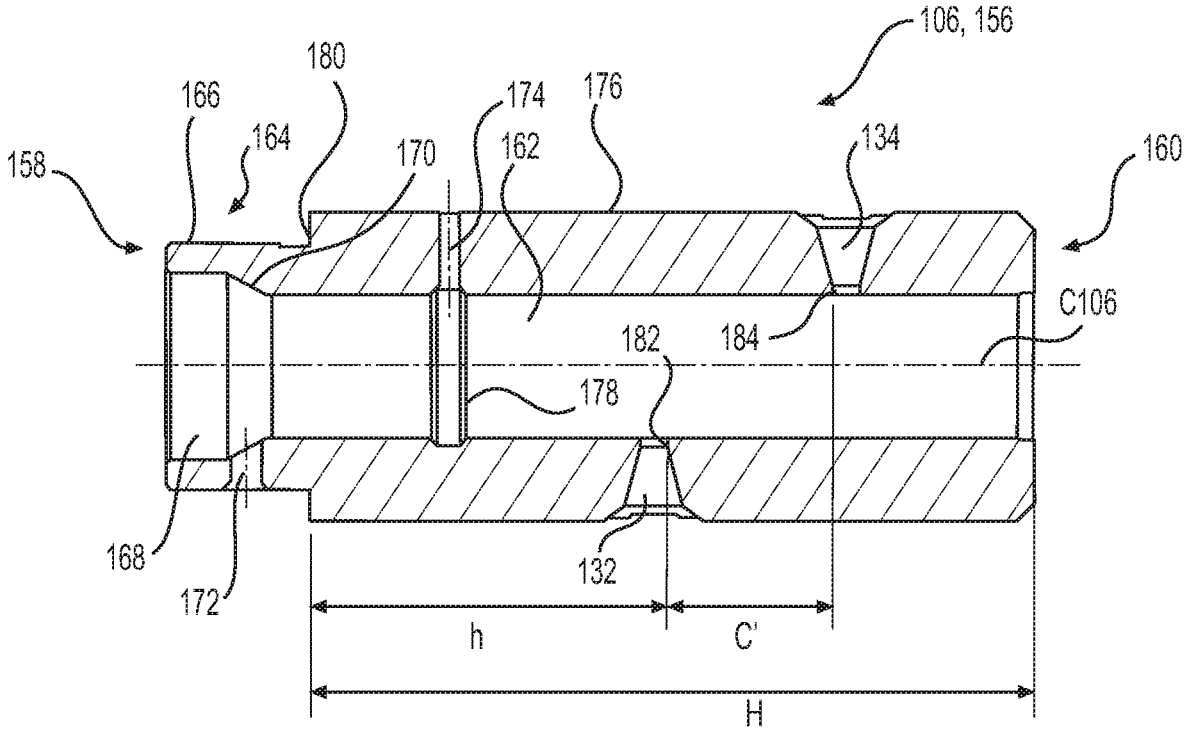
FIG. 4 is a cut-away side view of the bushing of FIG. 3, depicting more clearly the features and the dimensions of the bushing.

Looking now at FIGS. 3 and 4, an embodiment of the bushing 106 used in the fuel injector assembly 100 that is manufactured to retard the timing of the injection event is illustrated. The bushing 106 comprises a substantially cylindrical body 156 defining an upper end 158 and a lower end 160, relative to how the bushing 106 is typically installed in the fuel injector assembly 100. A central bore 162 extends completely through the body 156 from the upper end 158 to the lower end 160. This central bore 162 is configured to receive the plunger 108 and allow the plunger to slide up and down freely in the bushing 106. The upper end 158 includes a necked down portion 164 compared to the rest of body 156 of the bushing 106. As can be understood looking at FIG. 2, this necked down portion 164 may be configured to mate with the body 102 of the injector. For example, the circumferential surface 166 of the necked down portion 164 may be configured with external threads to mate with the internal threads of the body 102 of the injector or it may be otherwise attached to the body of the injector.

Referring back to FIGS. 3 and 4, the central bore 162 may have an enlarged diameter 168 in the necked down region 164 compared to the rest of the bore 162 positioned in the rest of the body 156 of the bushing 106. A chamfer 170 or other lead-in surface may be provided at the transition from the enlarged diameter 168 to the rest of the bore 162 to facilitate the insertion of the plunger 108 into the bushing 106 during assembly of the fuel injector assembly 100.

An upper cross-bore 172 may extend from the circumferential surface 166 of the necked down portion 164 of the bushing 106 to the chamfer 170 along a direction perpendicular to the cylindrical axis C106 of the bore 162 and/or bushing 106. A pin (not shown) or the like may be inserted into the upper cross-bore 172 to aid in timing the circumferential orientation of the bushing 106 relative to the fuel injector assembly 100. A lower cross-bore 174 may also be provided that extends from the outer circumferential surface 176 of the body 156 of the bushing 106 below the necked down portion 164 along a direction perpendicular to the cylindrical axis C106. The lower cross-bore 176 may be in communication with an internal circumferential groove 178 that is in fluid communication with the central bore 162. The lower cross-bore 176 and the internal circumferential groove 178 may provide lubrication to aid in the movement of the plunger 108.

Looking now at FIGS. 2 and 4, and as alluded to earlier herein, the body 156 of bushing 106 also defines a top port 132 and a bottom port 134 that extend from the outer circumferential surface 176 of the main portion of the body 156 of the bushing 106 to the central bore 162. For the embodiment shown in the figures, these ports 132, 134 extend in diametrically opposite directions. It is contemplated that this might not be the case in other embodiments. The distance from the shoulder 180 proximate the necked down portion 164 to the bottom inside portion 182 of the top port 132 defines the injection timing distance h for the bushing 106 as the position of the shoulder 180 to the rest of the fuel injector assembly 100 is fixed. Increasing the injection timing distance h retards the time at which the injection phase starts because it will take longer for the upper helix 144 of the plunger to cover the top port 132 completely, resulting in pressurization of the fuel in the pressurization chamber 136 that causes injection of the fuel from the fuel injector assembly 100 into the combustion chamber.

As also alluded to earlier herein, the injection duration distance C, also referred to as the effective injection stroke, is measured from the bottom inside portion 182 of the top port 132 to the top inside portion 184 of the bottom port 134. In some embodiments, it may be desirable to decrease this distance (to C') to reduce the amount of fuel injected for increased fuel economy and a reduction in emissions.

A natural consequence of increasing the injection timing distance h is to reduce the volume v of pressurized fuel available to inject into the combustion chamber. On the other hand, the natural consequence of decreasing the injection duration distance to C' is to slightly increase the volume v of pressurized fuel available to inject into the combustion chamber. Usually, the decrease in the injection duration distance to C' is so small compared to the increase in the injection timing distance h that there will usually be a decrease in the volume v of pressurized fuel available to inject when both changes occur simultaneously.

It is contemplated that in certain embodiments, only a change in the injection timing distance for the bushing is made, while in other embodiments only a change in the injection duration distance is made. In many embodiments, changes to both the injection timing distance and the injection duration distance may be made simultaneously.

Referring now to FIGS. 2 and 4, the pertinent variables and distances can be measured and expressed mathematically in the following manner. It is to be understood that all the dimensions and variables discussed herein are measured in a direction parallel to the direction of travel 148 of the plunger 108, which is also the same as the cylindrical axis C106 of the bushing 106. A timing distance t is set by the effective length of the follower 112 and may be adjusted using the screw adjustment discussed earlier herein but this option may not be available in all embodiments and may be prone to user error. This timing distance t is typically specified on the engine data plate. Distance s corresponds to the distance from the top of the follower 112 to the upper helix 144. Distance s moves downward as the follower 112 and plunger 108 are pushed downwards by the rocker arm 120 until the plunger 108 moves far enough downward so that the injection event commences. The amount the plunger 108 needs to move downward until the upper helix 144 reaches the bottom inside portion 182 of the top port 132 is represented by distance p.

For the bushing 106 itself, distance D may correspond to the original distance from the shoulder 180 of the bushing 106 to the bottom inside portion 182 of the top port 132 before the amount of injection timing retardation has been determined. Distance h corresponds to the adjustment of distance D after the distance r required to retard the injection timing a suitable amount has been added. Mathematically, $h=D+r$.

Similarly, distance C equals the original distance from the bottom inside portion 182 of the top port 132 to the top inside portion 184 of the bottom port 134. Distance C' equals distance C minus the effective stroke reduction a. The effective stroke reduction may be determined empirically. Mathematically, $C'=C-a$.

The following equations explain how to adjust a known bushing configuration to obtain the desired new bushing configuration. This method allows the same original plunger, same screw set point, and timing distance be used.

First, the amount of timing retardation r is calculated using the formula of r=0.012 inches×(degrees of desired retardation). If D was originally 1.304 inches and it is desired to retard the injection timing by seven degrees (see embodiment 1 in the table below), then h=1.304 inches+(0.012 inches×7 degrees of retardation), or h=1.388 inches. Likewise, if C was originally 0.6402 inches and it was desired to have an effective stroke reduction (a) of 0.0026 of an inch, then C'=0.6376 inches. It should be noted that the value of 0.012 of an inch used to calculate r is a coefficient that is dependent on the interaction of the cam shaft with the other components located between the cam shaft and the plunger. Additionally, other parameters such as the design of the engine components may also affect this coefficient. So, this coefficient may change depending on the application. Similar statements may also be made regarding the effective stroke reduction (a).

In addition, it may be desirable to express the relationship of some these variables in dimensionless terms. For example, the height H of the main portion of the body 156 of the bushing 106 may be divided by the h or the modified injection timing distance to yield an injection timing ratio R. Modified bushings that yield the desired injection timing ratio R will be able to provide the desired retardation of injection timing while still being able to fit within existing fuel injector assemblies nor otherwise make the fuel injector assembly unsuitable for its intended engine application (e.g. the length of the fuel injector assembly is not unsuitably altered).

Similarly, it may also be desirable to express the relationship of the height H of the main portion of the body 156 of the bushing 106 divided by the modified injection duration distance C' to yield an injection duration ratio I. Modified bushings that yield the desired injection duration ratio I will be able to provide the desired reduction in the effective injection stroke while still being able to fit within existing fuel injector assemblies nor otherwise make the fuel injector assembly unsuitable for its intended engine application (e.g. the length of the fuel injector assembly is not unsuitably altered).

Also, in many applications, there will be an overall injection adjustment ratio X that equals R/I. This ratio may represent the overall improvement of the injection timing taking into account both the reduction in the amount of fuel injection and the retarding of the injection timing. This may be present even in applications where the adjustment in the injection timing is not made relative to a shaft of the engine (such as example six in Table I).

TABLE I

| | Bushing Embodiments | | | | | |
|---|---|---|---|---|---|---|
| | 1 | 2 | 3 | 4 | 5 | 6 |
| Dimension C (inches) | .6402 | .6402 | .6402 | .6715 | .6715 | .6715 |
| Dimension D (inches) | 1.304 | 1.304 | 1.304 | 1.296 | 1.296 | 1.296 |
| Modified Dimension C' (inches) | .6376 | .6376 | .6412 | .6820 | .6820 | .6820 |
| Modified Dimension h (inches) | 1.388 | 1.376 | 1..412 | 1.344 | 1.368 | 1.296 |
| Angle of retardation of injection timing (degrees) | 7 | 6 | 9 | 4 | 6 | 0 |
| Effective injection stroke reduction (a) (inches) | .0026 | .0026 | .0010 | .0105 | .0105 | .0105 |
| Injection Timing Ratio R (H/h) | 2.0148 | 2.0323 | 1.9805 | 2.0807 | 2.0442 | 2.1578 |
| Injection Duration ratio I (H/C') | 4.3860 | 4.3860 | 4.3614 | 4.1004 | 4.1004 | 4.1004 |
| Overall Injection Adjustment ratio X (R/I) | 2.1769 | 2.1581 | 2.2022 | 1.9707 | 2.0059 | 1.9003 |

Table I above provides six embodiments of bushings having various dimensions and ratios that result from using these calculations. It should be noted that a range may be provided for ratios R, X and I to compensate for tolerances and various other adjustments concerning the amount of injection timing retardation and reduction in the effective injection stroke. In many applications, values for the H dimension could vary from 2.7 to 3.0 inches and may actually be approximately 2.8 inches in some applications. In some embodiments of the bushing, the injection timing ratio R ranges from 1.9 to 2.2 and more particularly, from 1.98 to 2.035 and from 2.04 to 2.16 in various embodiments and the injection duration ratio I ranges from 4.0 to 4.4 and more particularly, from 4.36 to 4.39 and from 4.0 to 4.2 in various embodiments. Similarly, the overall injection adjustment ratio X may range from 1.9 to 2.250, and more particularly, from 1.90 to 2.006 and from 2.15 to 2.205 in particular embodiments. Any of the variables discussed herein may vary from what has been specifically mentioned herein as needed or desired.

INDUSTRIAL APPLICABILITY

In practice, a bushing according to any embodiment described herein may be provided, sold, manufactured, and bought etc. to refurbish, retrofit or remanufacture existing fuel injector assemblies to retard the timing of the injection of the fuel injector. Similarly, a fuel injector assembly may also be provided, sold, manufactured, bought, etc. to provide a new fuel injector that consumes less fuel and/or contributes less to the creation of undesirable emissions of an engine. The fuel injector assembly or bushing may be new or refurbished, remanufactured, etc.

Figure 5:
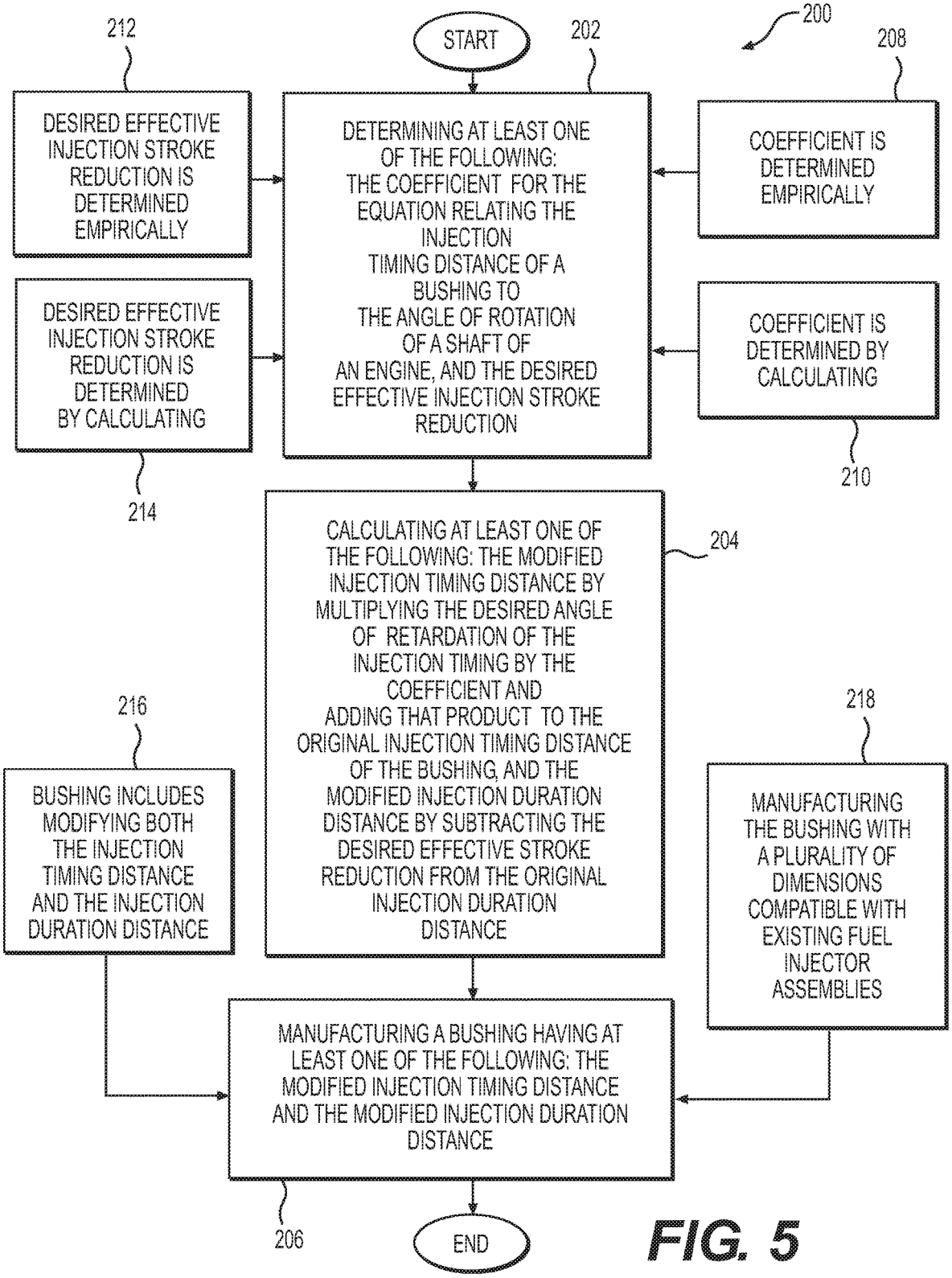
FIG. 5 is a flow chart containing a method for manufacturing or designing a bushing according to various embodiments of the present disclosure.

FIG. 5 is a flow chart delineating a method for manufacturing or designing a bushing according to various embodiments of the present disclosure. The method 200 may comprise: determining at least one of the following: the coefficient for the equation relating the injection timing distance of a bushing to the angle of rotation of a shaft of an engine, and the desired effective injection stroke reduction for the equation relating the injection duration distance of a bushing (step 202). The method may further comprise calculating at least one of the following: the modified injection timing distance by multiplying the desired angle of retardation of the injection timing by the coefficient and adding that product to the original injection timing distance of the bushing, and the modified injection duration distance by subtracting the desired effective stroke reduction from the original injection duration distance (step 204), and manufacturing a bushing having at least one of the following: the modified injection timing distance and the modified injection duration distance (step 206).

The angle of retardation may be determined with respect to a cam shaft, crank shaft, etc. of the engine.

In some embodiments, the coefficient is determined empirically (step 208), such as by using a design of experiments, etc. In other embodiments, the coefficient is calculated (see step 210), such as by equations, CAD, etc.

Likewise, the desired effective injection stroke reduction may be determined empirically (see step 212) or the desired effective injection stroke reduction may be determined using a calculation (see step 214).

In many embodiments, the bushing includes modifying both the injection timing distance and the injection duration distance (see step 216).

Likewise, in many embodiments, the method includes manufacturing the bushing with a plurality of dimensions compatible with existing fuel injector assemblies already manufactured (see step 218). This may aid in refurbishing or repairing injector assemblies already in the field. For example, the diameter or length of any portion of the bushing may be kept the same so that the modified bushing may be substituted for the original bushing without interfering with the original design of the engine or fuel injector. A bushing made according to any steps of this method may then be made available to the public or may be provided to the user.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A bushing for use with a fuel injector, the bushing comprising:

a substantially cylindrical body defining a cylindrical axis, an upper end, and a lower end disposed along the cylindrical axis, the body including a main body portion disposed proximate the lower end and a necked down portion disposed proximate the upper end with a shoulder connecting the necked down portion to the main body portion;

the body also defining a central bore extending completely through the body from the upper end to the lower end along the cylindrical axis;

the main body portion including an outer circumferential surface;

the main body portion defining a top port extending from the outer circumferential surface to the central bore, the top port forming a bottom inside portion at the intersection of the top port with the central bore; and the main body portion defining a bottom port extending from the outer circumferential surface to the central bore, the bottom port forming a top inside portion at the intersection of the bottom port with the central bore;

wherein the main body portion defines an injection timing distance measured along the cylindrical axis from the shoulder to bottom inside portion of the top port, and the main body portion defines a main body height measured along the cylindrical axis from the shoulder to the lower end, and a ratio of the main body height to the injection timing distance ranges from 1.9 to 2.2;

the main body portion defines an injection duration distance measured along the cylindrical axis from the bottom inside portion of the top port to the top inside portion of the bottom port and a ratio of the main body height to the injection duration distance ranges from 4.0 to 4.4;

the bushing defines an overall injection adjustment ratio that equals the ratio of the injection timing distance to the injection duration distance, and this ratio ranges from 1.9 to 2.250; and the main body height is from 2.7 inches to 3.0 inches.

2. The bushing of claim 1, wherein the ratio of the main body height to the injection timing distance ranges from 1.98 to 2.035 or 2.04 to 2.16.

3. The bushing of claim 1, wherein the ratio of the main body height to the injection duration distance ranges from 4.36 to 4.39 or 4.0 to 4.2.

4. The bushing of claim 1, wherein the overall injection adjustment ratio ranges from 1.90 to 2.006 or 2.15 to 2.205.

5. The bushing of claim 1 wherein:

the injection duration distance is equal to the injection duration distance (C') in one of the embodiments 1-6 of Table 1; and the injection duration ratio (I) is equal to the main body height (H) divided by the injection duration distance (C') of the corresponding one of the embodiments 1-6 in Table 1.

6. A fuel injector assembly comprising:

a housing that defines a pressurized fuel chamber;

a check valve assembly in fluid communication with the pressurized fuel chamber;

a plunger disposed in the housing;

a bushing disposed in the housing configured to guide the movement of the plunger; wherein the bushing includes a substantially cylindrical body defining a cylindrical axis, an upper end, and a lower end disposed along the cylindrical axis, the body including a main body portion disposed proximate the lower end and a necked down portion disposed proximate the upper end with a shoulder connecting the necked down portion to the main body portion;

the body also defining a central bore extending completely through the body from the upper end to the lower end along the cylindrical axis;

the main body portion including an outer circumferential surface;

the main body portion defining a top port extending from the outer circumferential surface to the central bore, the top port forming a bottom inside portion at the intersection of the top port with the central bore; and the main body portion defining a bottom port extending from the outer circumferential surface to the central bore, the bottom port forming a top inside portion at the intersection of the bottom port with the central bore;

wherein the main body portion defines a main body height measured along the cylindrical axis from the shoulder to the lower end and defines an injection duration distance measured along the cylindrical axis from the bottom inside portion of the top port to the top inside portion of the bottom port and a ratio of the main body height to the injection duration distance ranges from 4.0 to 4.4;

the main body portion defines an injection timing distance measured along the cylindrical axis from the shoulder to bottom inside portion of the top port and a ratio of the main body height to the injection timing distance ranges from 1.9 to 2.2;

the bushing defines an overall injection adjustment ratio that equals the ratio of the injection timing distance to the injection duration distance, and this ratio ranges from 1.9 to 2.250; and the main body height is from 2.7 inches to 3.0 inches.

7. The fuel injector assembly of claim 6, wherein the ratio of the main body height to the injection duration distance ranges from 4.36 to 4.39 or 4.0 to 4.2.

8. The fuel injector assembly of claim 6, wherein the ratio of the main body height to the injection timing distance ranges from 1.98 to 2.035 or 2.04 to 2.16.

9. The fuel injector assembly of claim 6, wherein the overall injection adjustment ratio ranges from 1.90 to 2.006 or 2.15 to 2.205.13.

10. The fuel injector of claim 6 wherein the fuel injector is a mechanical unit injector.

11. The fuel injector assembly of claim 6 wherein:

the injection duration distance is equal to the injection duration distance (C') in one of the embodiments 1-6 of Table 1; and the injection duration ratio (I) is equal to the main body height (H) divided by the injection duration distance (C') of the corresponding one of the embodiments 1-6 in Table 1.

* * * * *